United States Patent [19]

Kelley

[11] Patent Number: 4,750,860

[45] Date of Patent: Jun. 14, 1988

[54] FAN

[75] Inventor: Francis E. Kelley, Sunnyvale, Calif.

[73] Assignee: Tandem Computers Incorporated, Cupertino, Calif.

[21] Appl. No.: 5,057

[22] Filed: Jan. 20, 1987

Related U.S. Application Data

[63] Continuation-in-part of Ser. No. 880,361, Jun. 30, 1986, abandoned.

[51] Int. Cl.[4] ..... F04D 29/66

[52] U.S. Cl. ..... 415/119; 181/205; 181/225

[58] Field of Search ..... 415/119; 181/225, 202, 181/204, 205, 277

[56] References Cited

U.S. PATENT DOCUMENTS

| | | | |
|---|---|---|---|
| 2,415,621 | 2/1947 | Arnhym | 415/119 |
| 2,648,396 | 8/1953 | Kirby | 15/352 |
| 3,540,547 | 11/1970 | Coward, Jr. | 181/50 |
| 3,750,842 | 8/1973 | McCaffrey, Jr. | 181/204 |
| 3,762,497 | 10/1973 | Hatz et al. | 181/204 |
| 3,779,341 | 12/1973 | Huggins | 181/50 |
| 3,903,562 | 9/1975 | Miles | 15/301 |
| 3,930,559 | 1/1976 | Frick | 181/33 K |
| 3,947,148 | 3/1976 | Holt | 415/119 |
| 3,976,393 | 8/1976 | Larson | 415/119 |
| 3,980,912 | 9/1976 | Panza | 310/51 |
| 4,226,298 | 10/1980 | Bancel et al. | 188/277 |
| 4,258,821 | 3/1981 | Wendt et al. | 181/202 |
| 4,435,877 | 3/1984 | Berfield | 15/326 |
| 4,508,486 | 4/1985 | Tinker | 415/119 |
| 4,533,370 | 8/1985 | Ikezake et al. | 55/276 |

FOREIGN PATENT DOCUMENTS

| | | | |
|---|---|---|---|
| 2506364 | 8/1976 | Fed. Rep. of Germany | 415/119 |
| 3042431 | 6/1982 | Fed. Rep. of Germany | 415/119 |
| 1234151 | 10/1960 | France | 415/119 |

*Primary Examiner*—Robert E. Garrett
*Assistant Examiner*—John T. Kwon
*Attorney, Agent, or Firm*—Townsend and Townsend

[57] ABSTRACT

An improved fan, for mounting adjacent an opening in a mounting plate, includes blades rotatable about an axis and within a cylindrical housing. The fan blades move air through the opening in the mounting plate. A cylindrical, open-cell foam collar encircles the fan housing. The collar is sized so that the collar extends a substantial distance upstream past the edge of the collar. The foam collar reduces the acoustic noise from the fan by damping the housing vibration and also by acting as a barrier to muffle sound waves in the air. In addition, the foam collar straightens out the air flow prior to entering the fan blades making it more laminar and less turbulent to increase the efficiency of the fan.

13 Claims, 2 Drawing Sheets

FAN

This application is a continuation-in-part of application Ser. No. 880,361, filed June 30, 1986 for Air Fan Noise Suppression Apparatus, now abandoned.

BACKGROUND OF THE INVENTION

Much equipment, such as computers and disc drives, generate sufficient heat to require the use of fans to cool the components. Fans, unfortunately, can generate sufficient acoustic noise so that the work place becomes, at least, an unpleasant place to work.

In response to this, many types of acoustic shielding have been devised. For example, U.S. Pat. No. 4,508,486 shows a ventilation fan having a perforated inner casing, a solid outer casing and a porous, sound absorbing material between the two. U.S. Pat. No. 3,540,547 to Coward shows a complex, 5 layer sound absorbing panel including an inner perforated layer, two sound absorbing layers and two solid layers. U.S. Pat. No. 3,947,148 to Holt shows a fan having a cylindrical duct with slots in the duct. A foam layer surrounds the duct and extends through the slots to minimize the clearance between the ends of the fan blades and the inner wall of the duct. Any sound reduction scheme must, however, ensure that any reduction in sound levels does not create an unacceptable reduction in flow rates, does not have an unacceptable cost and does not reduce the ability of the user to work with the equipment to any substantial extent.

SUMMARY OF THE INVENTION

The present invention is directed to an improved fan in which noise level is reduced, while increasing the efficiency of the fan, in a simple, economical manner. The improved fan includes blades rotatable about an axis and within a cylindrical housing. The fan is mounted adjacent an opening in a mounting plate or like structure and forces air from one side of the mounting plate, through the opening and to the other side of the mounting plate. A cylindrical, opened-cell foam collar is mounted snugly over the fan housing. The collar is sized so that it extends a substantial distance upstream of the upstream edge of the housing, that is in the direction opposite the direction of air flow and away from the mounting plate. The foam collar reduces the acoustic noise from the fan by damping the housing (since it snugly surrounds the housing) and also by acting as a barrier to sound waves (since it extends past the upstream edge of the housing). In addition, the upstream portion of the foam collar straightens out the air flow prior to entering the fan blades to increase the efficiency of the fan.

A primary feature of the invention is that the open-cell foam collar reduces noise, by both damping the vibration of the fan housing and by absorbing acoustic noise (sound waves in the air) from the fan, and increases the fan efficiency by creating an air straightening entry channel so that the air flow, upon entering the fan blade region, is less turbulent and more laminar than it would be without the collar extension. This straightening of the flow lines increases the volumetric air flow through the fan to increase the efficiency of the fan.

One of the primary advantages of the invention is its simplicity. No modification need be made to conventional fan structures. All that is needed is a foam collar having an appropriate axial length and an appropriate radial thickness and sized to mount over the fan housing. Thus, the invention is especially suited for retrofit operations.

Other features and advantages of the invention will appear from the following description in which the preferred embodiment has been set forth in detail in conjunction with the accompanying drawings.

DETAILED DESCRIPTION OF THE PREFERRED EMBODIMENT

Figure 1:
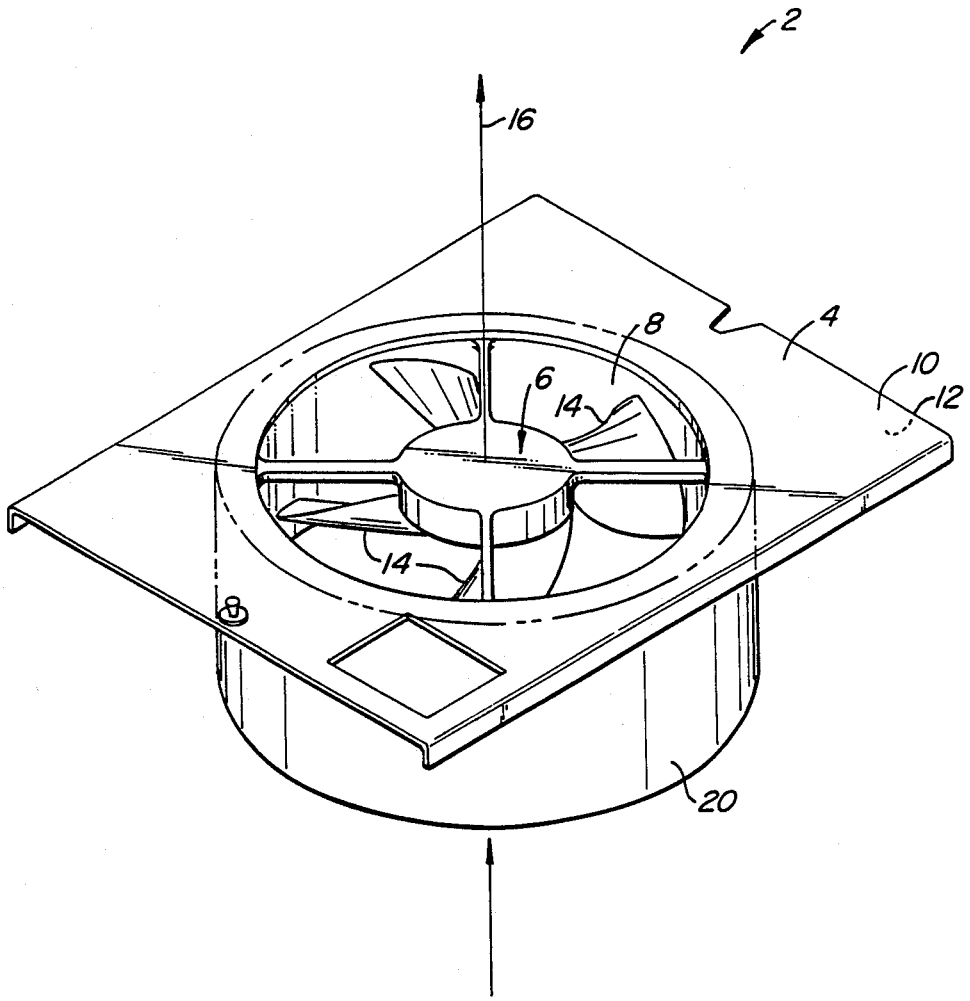
FIG. 1 is an isometric view showing a fan assembly made according to the invention.
Figure 2:
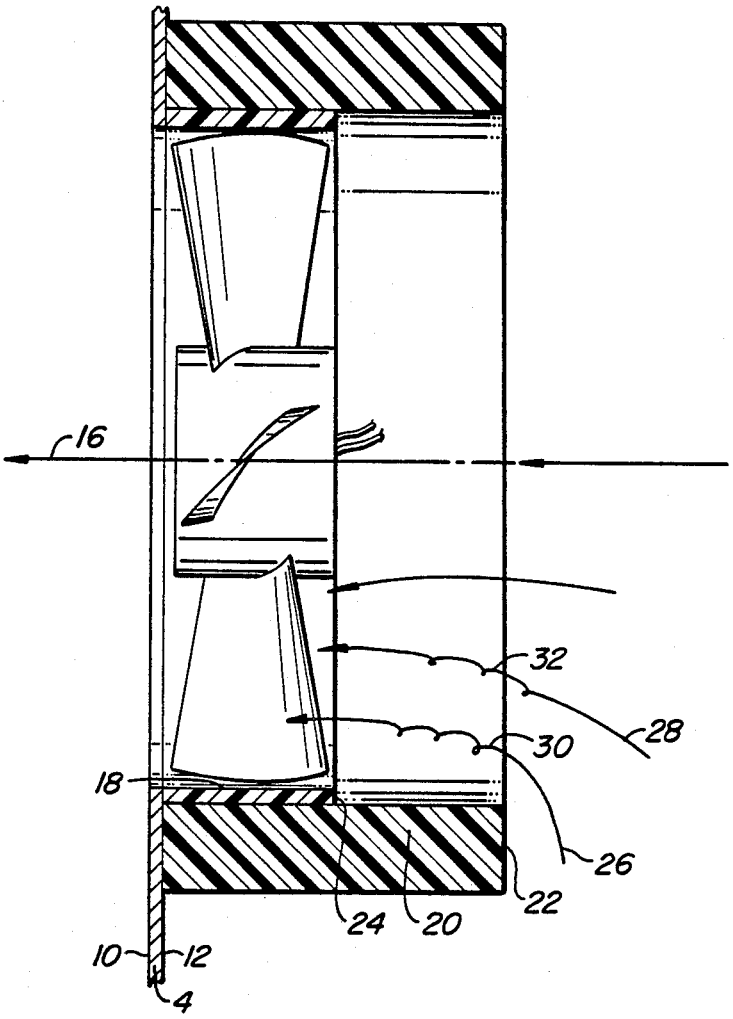
FIG. 2 is a simplified cross-sectional representation of the fan assembly of FIG. 1 illustrating the air flow paths.

Referring now to FIGS. 1 and 2, fan assembly 2 is shown to include a mounting plate 4 to which a fan 6 is mounted. Mounting plate 4 may be mounted to, or be an integral part of, the housing of the equipment being cooled. Mounting plate 4 has an opening 8 extending between its sides 10, 12, fan 6 being centered on opening 8.

Fan 6 includes a number of fan blades 14 adapted to direct air from side 12 of mounting plate 4 and through opening 8 in the direction of downstream arrow 16. Fan 6 also includes a fan housing 18 mounted to side 12 of mounting plate 4 and extending in the direction opposite arrow 16, that is upstream.

A foam collar 20 is mounted snugly about housing 18 and extends upstream from side 12 of mounting plate 4 to a position 22 past the outer edge 24 of fan housing 18.

In the preferred embodiment fan 6 has a diameter of about 6 inches, fan housing 18 has an axial length of $1\frac{1}{2}$ inches and foam collar 20 has an axial length of 3 inches and a $\frac{3}{4}$ inch radial thickness. Collar 20 is preferably made of an open-cell foam having 60–90 pores per inch. For a 6 inch diameter fan with a fan housing 18 having an axial length of $1\frac{1}{2}$ inches, it is preferred that the minimum length of collar 20 upstream of outer edge 24 be 1 inch while the minimum radial thickness of collar 20 be $\frac{1}{2}$ inch. Thus the minimum length of collar 20 upstream of outer edge 24 is at least a substantial portion of the length of housing 18.

In use, the user simply mounts collar 20 over housing 18 so to fully cover housing 18. Collar 20 is sized to snugly encircle housing 18 so to dampen vibration of housing 18 and therefore reduce noise from fan 6. While fan 6 is operating, air flow along lines 26, 28 have initial turbulent regions 30, 32. By the time the air flow reaches edge 24, the air flow is much less turbulent and more laminar as indicated by lines 26, 28. Thus collar 20 reduces noise by damping fan housing 18 and, to some extent, mounting plate 4 as well as by muffling the acoustic noise created by fan 6. Because the air flow entering the fan blades is much less turbulent than it would be without collar 20, the air flow volume is greater with foam collar 20 than without foam collar 20. Thus, the operational efficiency of fan 6 is also enhanced with the invention.

Modification and variation can be made to this disclosed embodiment without departing from the subject of the invention as defined in the following claims. The above-mentioned dimensions have been found to be suitable for use with a 6 inch diameter, 200 cubic foot per minute fan. For other size fans the dimensions may well differ.

I claim:

1. An improved fan assembly comprising:

a fan including blades rotatable about an axis, the fan operable to move air in a downstream direction along the axis;

a cylindrical fan housing mounted about the fan blades coaxially with the axis so to surround the fan blades, the fan housing being a chosen axial length with a downstream edge and an upstream edge; and a tubular foam collar sized to fit over the fan housing, the collar having a first portion, extending over the housing a first length in the downstream direction from the upstream edge, and a second portion, extending a second length from the upstream edge in an upstream direction opposite the downstream direction, the second length being at least a substantial portion of the first length;

whereby the foam collar reduces the noise from the fan assembly, by damping vibration of the fan housing and by muffling sound waves, and increases the air flow rate through the fan assembly.

2. The fan assembly of claim 1 further comprising a mounting plate having first and second sides and an air flow opening formed therein, the fan being mounted to the first side of the mounting plate at the air flow opening so that air flows from the first mounting plate side, through the opening and to the first mounting plate side, and wherein the downstream edge of the housing is adjacent the mounting plate.

3. The fan assembly of claim 2 wherein the fan housing is mounted directly to the mounting plate.

4. The fan assembly of claim 1 wherein the foam collar is cylindrical.

5. The fan assembly of claim 1 wherein the foam collar has a radial thickness of at least ½ inch.

6. The fan assembly of claim 1 wherein the foam collar is an open-cell foam collar.

7. The fan assembly of claim 6 wherein the foam collar has about 60–90 pores per inch.

8. The fan assembly of claim 1 wherein the first length of the foam collar is substantially equal to the chosen axial length of the fan housing.

9. The fan assembly of claim 1 wherein the fan has a diameter of about 6 inches, the fan housing has a chosen axial length of about 1½ inches, the first and second lengths of the collar are each about 1½ inches and the collar has a radial dimension of about ¾ inch.

10. An improved fan assembly comprising:

a mounting plate having first and second sides and an air flow opening formed therein;

a fan, including blades rotatable about an axis, mounted to the first side of the mounting plate at the air flow opening, the fan operable to blow air in a forward direction along the axis from the first side, through the opening and to the second side;

a cylindrical fan housing mounted about the fan blades coaxially with the axis so as to surround the fan blades and on the first side of the mounting plate, the fan housing being a chosen axial length with a downstream edge adjacent the mounting plate and an upstream edge spaced apart from the mounting plate; and a cylindrical, open-cell foam collar sized to fit over the fan housing, the collar having a first portion, housing a first length, covering the housing and a second portion extending in an upstream direction opposite the downstream direction, the second length being generally equal to the first length;

whereby the foam collar reduces the noise from the fan assembly, by damping vibration of the fan housing and by muffling sound waves, and increases the air flow rate through the fan assembly.

11. A method for improving the performance of a fan of the type mounted to a mounting structure adjacent an opening in the mounting structure so to blow air through the opening, the fan having blades surrounded by a cylindrical fan housing having upstream and downstream edges, the method comprising:

selecting a foam collar having an inside dimension sized for snug placement over the fan housing and having a chosen axial length; and mounting the foam collar over the fan housing with a substantial portion of the foam collar extending on either side of the upstream edge so the foam collar both reduces noise and aids flow through the fan.

12. The method of claim 11 wherein the selecting step includes the step of selecting a foam collar with a chosen axial length being substantially greater than the axial length of the fan housing.

13. The method of claim 12 wherein the chosen axial length is about twice the axial length of the fan housing.

* * * * *